US005211120A

United States Patent [19]

de Oliveira

[11] Patent Number: 5,211,120

[45] Date of Patent: May 18, 1993

[54] PROGRAMMABLE SEWING MACHINE

[76] Inventor: Marcelo S. de Oliveira, Kienhorstrasse 130, 100 Berlin 51, Fed. Rep. of Germany

[21] Appl. No.: 543,454

[22] Filed: Jun. 26, 1990

[30] Foreign Application Priority Data

Jun. 26, 1989 [DE] Fed. Rep. of Germany ..... 3921234

[51] Int. Cl.[5] ..... D05B 19/00

[52] U.S. Cl. ..... 112/121.11; 112/272; 112/275; 364/470

[58] Field of Search ..... 112/121.11, 454, 457, 112/121.12, 2, 275, 272; 364/470

[56] References Cited

U.S. PATENT DOCUMENTS 4,555,997 12/1985 Tancs ..... 112/121.11
4,682,554 7/1987 Goto et al. ..... 112/121.11 X
4,899,287 2/1990 Hulshoff et al. ..... 112/121.11 X

*Primary Examiner*—Peter Nerbun
*Attorney, Agent, or Firm*—Lee, Mann, Smith, McWilliams, Sweeney & Ohlson

[57] ABSTRACT

A programmable sewing machine is disclosed in which, by means of input elements associated with a control device, the program parts predetermining the operation are selected, connected together and/or linked, the sewing machine being controlled accordingly, and the seams or seam lengths being predetermined by sewn stitches between two points of a material to be sewn and in which as a function of the performance of the stitches predeterminable outputs associated with the control unit are switched. Stitch elements, defined by sewn stitches, and time elements, defined as the time connections between two points of the operation, are interconnected in a random order preselectable by the operator in accordance with the operation. When performing both stitch elements and time elements, outputs can be switched in controlled by the control device.

3 Claims, 1 Drawing Sheet

PROGRAMMABLE SEWING MACHINE

BACKGROUND OF THE INVENTION

The invention regards a method of operating a programmable sewing machine, an automat or the like, as well as a drive and control apparatus for performing the method.

DE-OS 37 22 962 discloses a method for operating a programmable sewing machine in which a specific program type is selected prior to inputting the sewing machine functions and prior to inputting one of the available sequences of program parts within each program type. The operator then additionally inputs different sewing parameters, e.g. the number of stitches per seam.

In the prior art, seams or seam lengths are defined by the connection of two points on a material to be sewn and are obtained by sewn stitches. While the number of stitches of the seams can be selected by the operator, the sequence in which the seams are concatenated is preprogrammed. Moreover it is possible to predefine specific events which occur as a function of the seam or of the sewing of the stitches. For example, a time with a preselected duration can elapse after the end of a seam with a preselected number of stitches. During the time e.g. the sewn part is conveyed away from the sewing machine and stacked. For this purpose the sewing machine control device has different outputs, which can be activated as a function of the seam or the number of stitches. Thus, for example, an output can be provided, which is switched in during a number of stitches programmed by the operator at the start of the seam, another output is switched in for a time programmed by the operator after stopping the needle at the end of the seam or an output is switched in throughout the entire seam length.

However, such control devices suffer from the disadvantage that, due to the way the sequence is programmed, the operator cannot associate a random output with a random seam or seam length. It is also not possible to switch in an output for a specific or non-specific time at a random point in the sewing sequence, or to insert or non-specific waiting time at a random point in the sewing machine sequence. This means that a given sequence of the sewing process is predetermined in a fixed manner and the parameters of number of stitches or time can only be modified within this fixed sequence.

Moreover it is not possible to make the execution of a seam or a time in the sewing process dependent on events that might occur during any arbitrary point or time of the sewing process.

The problem posed to the invention is therefore to provide a method for operating a sewing machine and an apparatus for controlling the same, which permits a greater flexibility in the working sequence, which inter alia leads to a time saving.

SUMMARY OF THE INVENTION

According to the invention there is provided a method for operating a programmable sewing machine, an automat or the like in which by means of input elements associated with a control device, program parts predetermining the operation are selected, connected together and/or linked. The sewing machine is controlled accordingly, and the seams or seam lengths are predetermined by sewn stitches between two points of a material to be sewn. Predetermined outputs associated with the control unit are switched as a function of the performance of the stitches. The stitch elements, defined by sewn stitches, and the time elements, defined as time connections between two points of the operation, can be interlinked in a random sequence preselected by the operator in accordance with the operation, so that both when performing the stitch elements and also the time elements, outputs can be switched in controlled by the control device.

Due to the fact that, in addition to the seam defined by the number of stitches, a so-called time element is given, far more different operations can be set and selected by the operator without requiring a change to the basic program, i.e. without having to change the EPROM provided in the control or any other memory with the program. In the time element the connection between two points of an operation is carried through as the time between the two points.

BRIEF DESCRIPTION OF THE DRAWINGS

An apparatus for performing the method according to the invention is shown in two embodiments in the drawings and is explained in greater detail hereinafter together with the method.

DETAILED DESCRIPTION OF THE INVENTION

Figure 1:
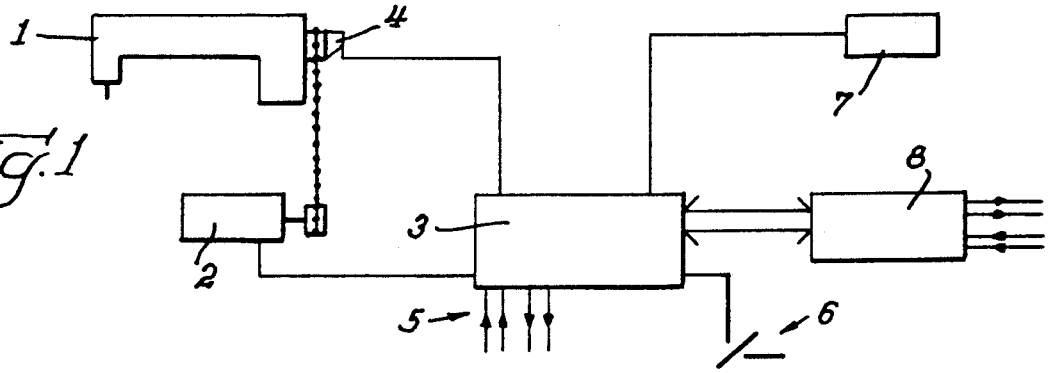
FIG. 1 diagrammatically illustrates the arrangement of the control for performing the method according to a first embodiment.

In FIG. 1 a sewing machine 1 is operated by means of a motor 2. The motor 2 is connected to a main microprocessor system 3, hereinafter called main microprocessor 3, which receives information on the position of the needle of the sewing machine 1 through a synchronizer 4. The main microprocessor 3 has several machine-specific inputs and outputs 5 and is connected to a pedal 6 by means of which the operator can control the sewing process. The basic program for the sewing processes to be selected is stored in the memory of the main microprocessor 3, which can e.g. be in the form of an EPROM. By means of an operator control panel 7, which can e.g. have a matrix-like input field for the different parameters, the operator can carry out the desired inputting of sewing parameters and the sequence of seams, as will be described hereinafter. The inputted information is stored in an EEPROM associated with the main microprocessor 3. As a function of the stored basic program and the inputted parameters and the sequence, programmable inputs and outputs 8 are switched.

Figure 2:
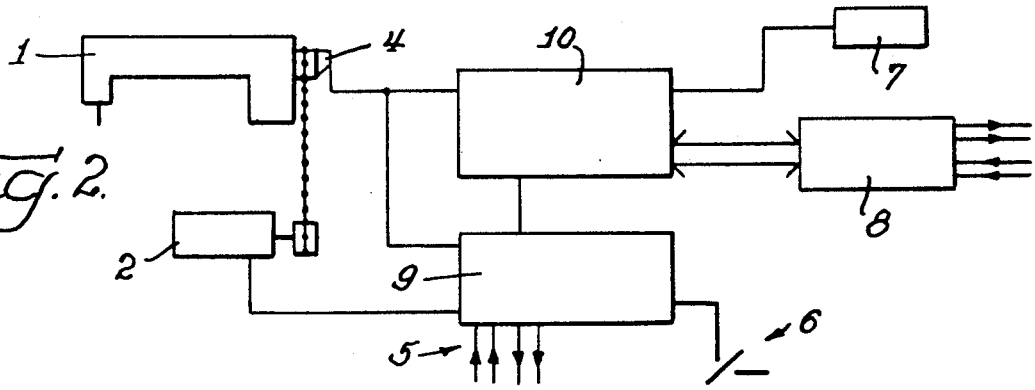
FIG. 2 diagrammatically illustrates the arrangement of the control for performing the method according to a second embodiment.

FIG. 2 shows an embodiment in which a sewing machine with a conventional prior art control was subsequently equipped so that the method according to the invention can be performed. There is a secondary microprocessor system 9 for the standard sewing machine control and also a main microprocessor with memory 10, which controls the secondary microprocessor 9 and, in accordance with FIG. 1, the programmable inputs and outputs 8.

For processing the method a "stitch element" and a "time element" are defined. A stitch element represents the known connection between two points of an operation by sewn stitches, and a time element represents the connection between two points of an operation considered as the time between the two points. Thus, the time element is not a real, physical seam, but rather a time concept.

During the inputting or programming of the working sequence of the sewing process by the operator, i.e. the inputting of the sequence of seams, in this embodiment twelve seams can be successively linked. These can be both stitch elements, i.e. effectively sewn seams, and time elements during which a time elapses while something is to take place. One seam or element can occur more than once in the sequence defined by parameters EL01 to EL12. These parameters can each be given a letter between A and L standing for the elements A to L. The inputting of programming can e.g. be performed by means of keys on the operator control panel 7. To be able to determine the end of the sequence, the input "END" is associated with one of these parameters. An example is EL01 - K, EL02 - B, EL03 - F and EL04 - END, i.e. the thus defined operation comprises three elements in the order K - B - F, whereby these elements can be time elements or stitch elements. Further parameters associated with the elements indicate what is to be carried out during the processing of the elements.

The duration and incorporation into the working sequence are significant for defining the time element. A time element can have a specific or a non-specific duration. A specific element occurs if the start and finish of the element are known, if it is e.g. 200 ms long. A time element has a non-specific duration, if the end of the element is not known. For example a started element can continue until a key is activated. A maximum time can be given as the upper limit for the time element, so that faulty situations can be detected. If e.g. the key is not activated within 5 s (maximum time), then a fault exists and a corresponding fault indication takes place.

As far as the incorporation of a time element into the working sequence is concerned, it can take place in the "foreground" or in the "background". It takes place in the foreground if the following element can be started only after the end of the time element. It takes place in the background if the following element can be started before the end of the time element, i.e. immediately after starting the time element. The time element then runs parallel to the following element.

A time element does not influence the state of the sewing motor 2, i.e. the motor e.g. rotates with a constant speed during the time element if it had a constant speed before the start of the latter. However, if the motor was stationary before the start of the time element, it is not brought into motion.

With respect to the elements, one or more outputs 8 can be connected in and this, applies both with regard to a stitch element and with regard to a time element. If e.g. an output is to be switched in at the end of a number of stitches for a specific time, then, prior to the sewing process, first a stitch element and subsequently a time element are inputted. The stitch element has a specific number of stitches and the time element a specific duration, during which the output is switched in. In the prior art the basic program in such a case was so fixed that the stitch element was always followed by a time during which the output was switched in. The time had a fixed association with the stitch element, so that the sequence of the stitch element with the following time element could not be modified by the operator.

The start and end conditions must be pre-established as parameters for each element of the operating sequence. The start condition is that which must be fulfilled after the end of the previous element, so that the next element is started. At the start condition, the operator can choose between (a) pedal 6 toed forwards, (b) photocell covered, (c) one or more inputs and (d) a combination of the first three possibilities. The photocell is associated with the sewing machine and it reacts to the presence of material in the vicinity of the needle. The inputs 8 are switched as a function of externally performed operations, e.g. by a limit switch or the like. It is also possible to take the end of the previous element in the sequence as the start condition, without having to additionally choose one of the possibilities (a) to (d).

The end condition is that which must be fulfilled in order to introduce the end of the seam. As the end condition the operator can choose between (a) pedal 6 heeled backwards, (b) photocell uncovered, (c) one or more inputs, (d) a stich count and (e) a combination of the first four possibilities. In the case of the time element with a specific duration, the end of the predetermined duration is simultaneously the end condition for the time element itself.

In addition to the start and end condition a skip condition can be used to avoid the execution of an element or elements dependent on an event or events that can occur during the sewing operation. If the skip condition is fulfilled, the element or elements will not be executed and the operation will continue to the next executable element in the sequence. As the skip condition the operator can choose between (a) an input that can be activated or deactivated, (b) a photocell that can be covered and uncovered, (c) an output that can be on or off, (d) the motor that can be running or not, (e) another element that has been executed or not, and (f) any combination of the first five possibilities.

The fulfillment of the skip condition, and consequently the skipping of the execution of the element or elements, does not affect the execution of the other elements in the sequence, unless the execution of one or more of the other elements is dependent on an event that would have occurred during the skipped elements.

Hereinafter the method of the invention is further illustrated by three different examples. The operating sequence for the individual examples can be predetermined and inputted by the operator, whereas in the prior art a different basic program was necessary for each example.

Figure 3:
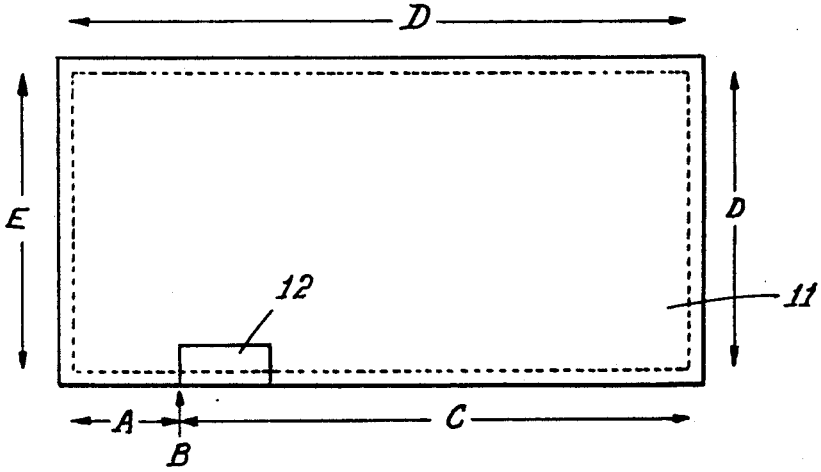
FIG. 3 shows a first example of a piece of textile material to be sewn with the method according to the invention.

According to FIG. 3 it is necessary to sew a tablecloth 11 while inserting a label 12. Seam or element A is to be sewn first. Through the operator control panel 7 the operator inputs the parameters associated with the stitch element A. In the present case the start condition selected is "pedal 6 toed forwards" and "photocell covered", while the end condition is a specific number of stitches (stitch count). The second element is constituted by a time element and the start condition is the end of element A. The time element B is undetermined and is ended by pressing a key. During time element B the presser foot is raised, so that the label can be inserted. This key, which is associated with an input, simultaneously forms the start condition for element C, whose end condition is "photocell uncovered". The start condition for element D is inputted as "pedal 6 toed forwards" and the end condition is the same as for element C. For element E the start condition is also "pedal 6 toed forwards" and as the end condition "photocell uncovered" is inputted, while additionally selecting the parameter "thread trim" at the end of element E.

By toeing the pedal 6 forwards and as a function of the values and parameters inputted by means of the operator control panel 7, the main processor 3 controls the sewing machine 1 in such way that first element A is sewn. In accordance with the preset number of stitches the motor 2 stops with the needle in the down position. During the undefined time element B, the operator can then insert label 12. Element C is started by means of an input, which is activated by the operator by pressing a key after inserting the label. When the tablecloth 11 has advanced to such an extent that the photocell after sewing C is uncovered and the photocell offset stitches between the position at which the photocell is located and the needle, have been sewn, the motor 2 stops with the needle in the down position. On toeing pedal 6 forwards, the element D starts, and then correspondingly the second element D. The same end conditions as for element C are processed. Element E is sewn in the same way, and at the end thereof the thread is trimmed. The sequence for the sewing operation for a tablecloth with label is A - B - C - D - D - E - END.

In case two types of tablecloth are being sewed, e.g. alternatively during the operating, one with label 12 and without any label, the skip condition of time element B can be defined as "photocell uncovered"(ply sensor), in which case time element B will not be executed if the photocell does not detect the presence of the label during the sewing time, and the operating will continue with seam C, which then has "end of the previous seam" as the start condition. The operator can concentrate at the sewing operating, knowing that the control apparatus will react to the presence or absence of the label 12 accordingly. The skip condition can be programmed by the operator.

For the second example the sewn material is to be stacked at the end of an operation. If at the aforementioned tablecloth sewing operation, a device moves the tablecloth from the sewing table to a stack, a signal of specific duration must be outputted by the main microprocessor 3 at the end of the operation, activating an output through which the device is controlled. This is obtained in that a time element F is defined, which has as the start condition the end of the preceding element (element E). During this time element an output is switched in. The sequence for the new operation is A - B - C - D - D - E -F - END.

Figure 4:
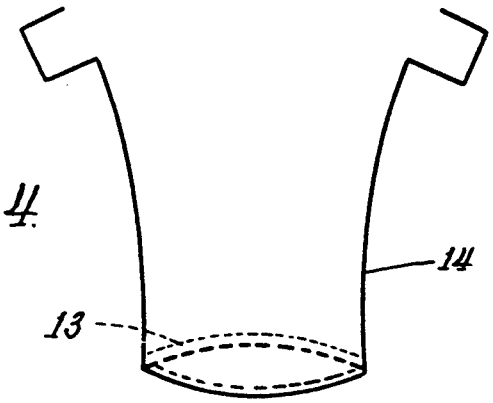
FIG. 4 shows a second example of a piece of textile material to be sewn with the method according to the invention.

As a further example, according to FIG. 4 the seam 13 of a vest 14 is sewn. The vest is placed on two driving rollers whereof one is stationary and the other mobile. The vest covers a photocell, which is taken as the start condition for a first time element. This element has been previously inputted as a time element with an undefined duration. During the time element once again an output 8 is activated. The signal applied to the output immediately following the insertion of the vest ensures that the movable driving roller is brought into a position in which the vest is slightly stretched. The signal remains active during the time element. A limit switch is located in this position and by means of a programmable input 8 informs the main microprocessor 3 or 10 that the desired position of the movable driving roller has been reached. The time element A is ended. The output is not switched off, because the vest must also be slightly stretched during sewing (element B). The stitch element B starts immediately due to the start condition "end of the previous element" following the time element A and is ended when a previously inputted number of stitches has been sewn, i.e. the stitch count serves as the end condition. The output is then switched off and the vest can be removed from the driving rollers. The sequence for the operation for sewing the vest 14 is then A - B - END.

It is obviously also possible to input other parameters, e.g. concerning the front or back backtacks, the speeds and the like.

What is claimed is:

1. A programmable sewing machine comprising a sewing machine (1) driven by a motor (2), with a control device (3) controlling the sewing machine (1) and the motor (2), which control device has a memory means for functioning of the sewing machine (1) and the motor (2), including means for interlinking data representative of stitch elements, comprising sewn stitches, and time elements, said time elements comprising time periods between two points of operation of the sewing machine, in a random sequence, the sequence not being preprogrammed in said memory means, an operator control panel (7) connected to the control device (3) for inputting the parameters of an operating program of the control device and having programmable inputs and outputs (8) associated with the control device.

2. Device according to claim 1 in which the control device is coupled to a secondary control device having means to control the motor.

3. Device according to claim 2 in which the control device is connected by means of a serial interface with the secondary control device, and the secondary control device includes means for starting and stopping of the motor.

* * * * *